US008749434B2

(12) United States Patent
Han et al.

(10) Patent No.: US 8,749,434 B2
(45) Date of Patent: Jun. 10, 2014

(54) DIELECTRIC RESONANT ANTENNA USING A MATCHING SUBSTRATE

(75) Inventors: Myeong Woo Han, Gyunggi-do (KR); Jung Aun Lee, Gyunggi-do (KR); Chul Gyun Park, Gyunggi-do (KR); Seung Ho Choi, Seoul (KR); Moonil Kim, Gyunggi-do (KR); Kook Joo Lee, Seoul (KR)

(73) Assignees: Samsung Electro-Mechanics Co., Ltd., Gyunggi-Do (KR); Korea University Research and Business Foundation, Seoul (KR)

( * ) Notice: Subject to any disclaimer, the term of this patent is extended or adjusted under 35 U.S.C. 154(b) by 215 days.

(21) Appl. No.: 12/841,884

(22) Filed: Jul. 22, 2010

(65) Prior Publication Data

US 2011/0248891 A1 Oct. 13, 2011

(30) Foreign Application Priority Data

Apr. 13, 2010 (KR) ..... 10-2010-0033999

(51) Int. Cl.
*H01Q 1/38* (2006.01)

(52) U.S. Cl.
USPC ..... 343/700 MS; 343/702; 343/767; 343/774

(58) Field of Classification Search
USPC ..... 343/700 MS, 702, 767, 911 R, 774; 333/204, 202, 206, 219, 222, 219.1, 333/235; 331/99, 96, 56; 505/210; 156/345, 156/41
See application file for complete search history.

(56) References Cited

U.S. PATENT DOCUMENTS

| | | | | |
|---|---|---|---|---|
| 6,219,002 | B1 * | 4/2001 | Lim | 343/769 |
| 7,205,898 | B2 * | 4/2007 | Dixon et al. | 340/572.1 |
| 7,750,755 | B2 * | 7/2010 | Fujita et al. | 333/26 |
| 2007/0052504 | A1 * | 3/2007 | Fujita | 333/238 |
| 2007/0080864 | A1 * | 4/2007 | Channabasappa | 343/700 MS |
| 2011/0057853 | A1 * | 3/2011 | Kim et al. | 343/843 |

FOREIGN PATENT DOCUMENTS

| | | |
|---|---|---|
| JP | 2004-112131 | 8/2004 |
| JP | 2007-074422 | 3/2007 |

OTHER PUBLICATIONS

Office Action from counterpart Korean Application No. 10-2010-0033999, mailed Aug. 31, 2011, 6 pages.

* cited by examiner

*Primary Examiner* — Douglas W Owens
*Assistant Examiner* — Jae Kim
(74) *Attorney, Agent, or Firm* — Bracewell & Giuliani LLP; Brad Y. Chin

(57) ABSTRACT

A dielectric resonator antenna is disclosed that includes a multi-layer substrate on which a plurality of insulating layers and conductor layers are alternately stacked. The dielectric resonator antenna also includes a first conductor plate that has an opening part on the upper portion of the top insulating layer of the multi-layer substrate and a second conductor plate that is formed on the lower portion of the bottom insulating layer from the first conductor plate. The insulating layer is formed with at least two stacked layers and is disposed at a position corresponding to the opening part. The dielectric resonator antenna also includes a plurality of first metal via holes, a feeding part and a matching substrate that is stacked on the opening part and is stacked with at least one insulating layer.

7 Claims, 13 Drawing Sheets

DIELECTRIC RESONANT ANTENNA USING A MATCHING SUBSTRATE

CROSS REFERENCE TO RELATED APPLICATION

This application claims the benefit of Korean Patent Application No. 10-2010-0033999, filed on Apr. 13, 2010, entitled "Dielectric Resonant Antenna Using Matching Substrate", which is hereby incorporated by reference in its entirety into this application.

BACKGROUND OF THE INVENTION

1. Technical Field

The present invention relates to a dielectric resonant antenna using a matching substrate.

2. Description of the Related Art

As a transmitting/receiving system according to the related art, products configured by assembling separate parts have been mainly used. However, recent study on system on package (SOP) products that makes the transmitting/receiving system using a millimeter wave band into a single package has been conducted. Some products of them have been commercialized.

A technology for providing the single package product has been developed, together with a multi-layer substrate process technology that stacks a dielectric substrate such as low temperature co-fired ceramic (LTCC) and liquid crystal polymer (LCP).

The aforementioned multi-layer substrate package is manufactured in a single process by integrating ICs, active devices, as well as building passive devices in the package. As a result, inductance component can be reduced due to the reduction in the number of conducting wires, inter-device coupling loss can be reduced, and production costs can be saved.

However, in the case of the LTCC process, shrinkage occurs by about 15% in x and y directions, that is, a substrate plane direction during the firing process, and thus, process errors occur, which reduces the reliability of the products.

In the multi-layer structure environment such as the LTCC process and the LCP process, a patch antenna having planar characteristics has been mainly used. However, this is unsuitable because the bandwidth of the patch antenna generally narrows by 5%.

In order to expand the bandwidth in the patch antenna, a patch antenna that generates multi-resonance by adding a parasitic patch on the same plane as the patch antenna serving as a main radiator or a stack-patch antenna that induces multi-resonance by stacking two or more patch antennas, and so on has been used.

It has been known that the related art can obtain a bandwidth of about 10% by using the multi-resonance technology.

However, when using the multi-resonance technology, a radiation pattern of an antenna may be different for each resonance frequency and the antenna characteristics due to the process errors may change to be larger than the single resonator antenna.

Therefore, in order to increase the efficiency of the antenna and secure a wider bandwidth of the antenna, and so on, a dielectric resonator antenna (DRA) has been used in the past.

It has been known that the existing dielectric resonator antenna has excellent characteristics in regards to the bandwidth and efficiency, compared with the existing multi-resonance patch antenna.

Although the existing dielectric resonator antenna is often used in order to improve the drawback of the existing patch antenna, it requires a separate dielectric resonator disposed outside of the substrate. Therefore, it is more difficult to manufacture the dielectric resonator antenna than the patch antenna having the stacked structure formed by the single process.

In addition, the dielectric resonator antenna can generate multi-resonance corresponding to the increase in the size of the dielectric resonator (for example, the length in a direction having no effect on the resonance frequency) to secure a wider bandwidth, but is disadvantageous in that the radiation pattern of the dielectric resonator antenna becomes skewed within the bandwidth.

Further, the dielectric resonator antenna generates a large reflected wave at an interface surface between a high-K multi-layer substrate including the dielectric resonator antenna and air which has a bandwidth narrower than the non-resonator antenna.

SUMMARY OF THE INVENTION

The present invention has been made in an effort to provide a dielectric resonator antenna that has low sensitivity to processing errors, improves a bandwidth without readjusting the size of the dielectric resonator antenna, and uses an easily fabricated matching substrate.

In addition, another object of the present invention provides a dielectric resonator antenna using a matching substrate that can prevent the change in antenna characteristics due to the insertion of foreign materials in the dielectric resonator antenna or surface damage of the antenna.

Further, still another object of the present invention provides a dielectric resonator antenna using a matching substrate capable of preventing loss and change in a radiation pattern due to a substrate mode by forming a plurality of via holes on the matching substrate.

In order to achieve the above objects, a dielectric resonator antenna according to an embodiment of the present invention includes: a dielectric resonator body part that is embedded in a multi-layer substrate and has an opening part on the upper portion thereof; and a matching substrate that is stacked on the opening part and is stacked with at least one insulating layer.

The dielectric resonator body part includes: a multi-layer substrate on which a plurality of insulating layers and conductor layers are alternately stacked; a first conductor plate that has an opening part on the upper portion of the top insulating layer of the multi-layer substrate; a second conductor plate that is formed on the lower portion of the bottom insulating layer from the first conductor plate, the insulating layer being formed with at least two stacked layers and is disposed at a position corresponding to the opening part; a plurality of first metal via holes that electrically connect each layer between the top insulating layer and the bottom insulating layer and vertically penetrate through the multi-layer substrate to form a metal interface surface in a vertical direction by covering the periphery of the opening part of the first conductor plate at a predetermined interval; and a feeding part including a feeding line to apply a high-frequency signal to the dielectric resonator embedded in the multi-layer substrate in a cavity form by a metal interface surface formed with the first conductor plate, the second conductor plate, and the plurality of first metal via holes.

In addition, the dielectric resonator body part further includes a conductor pattern part inserted in the dielectric resonator to form the metal interface surface in a vertical direction intersecting with the feeding line.

Further, the conductor pattern part is inserted in the dielectric resonator to include a plurality of second metal via holes that vertically penetrate through the multi-layer substrate; and at least one third conductor plate that is formed to be coupled with the plurality of second metal via holes between the insulating layer through which the plurality of second metal via holes penetrate.

Further, the feeding part is any one of a strip line structure, a micro strip line structure, or a CPW line structure.

Further, the dielectric constant of the matching substrate is smaller than that of the multi-layer substrate and is larger than that of air.

In addition, the matching substrate includes a plurality of via holes that vertically penetrate through the matching substrate to form the interface surface in a vertical direction by covering the periphery of the opening part of the dielectric resonator body part.

Further, the plurality of via holes are metal via holes.

Further, the plurality of via holes are air via holes.

Further, when at least two matching substrates are stacked, the matching substrates are stacked to gradually reduce the dielectric constant of the stacked matching substrate.

DESCRIPTION OF THE PREFERRED EMBODIMENTS

Figure 1:
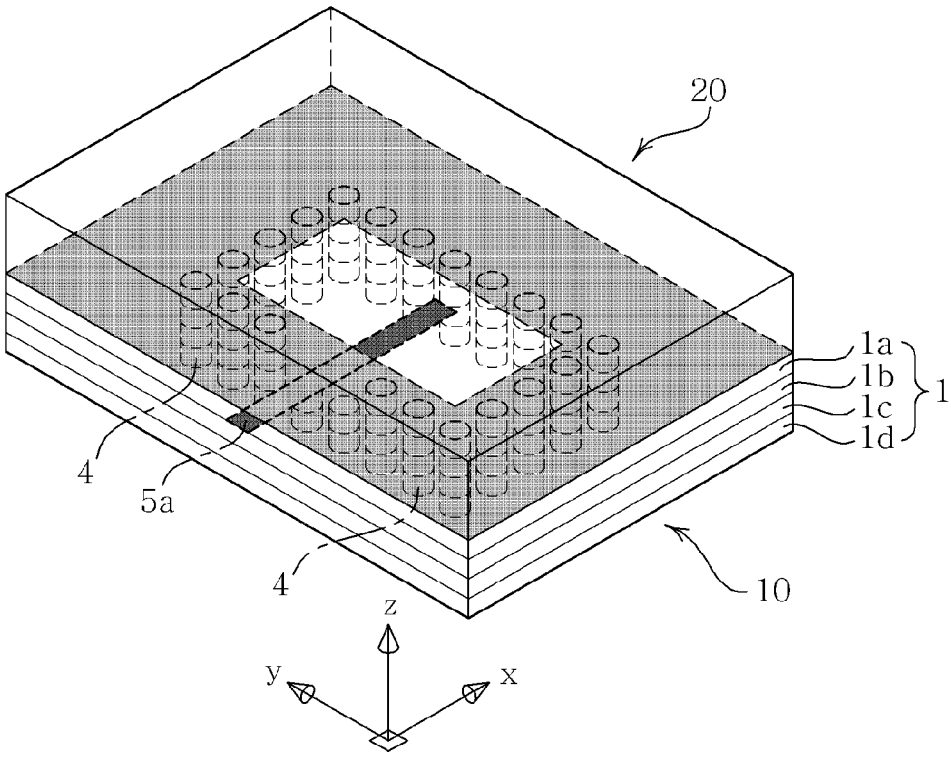
FIG. 1 is a perspective view of a dielectric resonator antenna using a matching substrate according to a first embodiment of the present invention.

Various objects, advantages and features of the invention will become apparent from the following description of embodiments with reference to the accompanying drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

The above and other objects, features and advantages of the present invention will be more clearly understood from the following detailed description taken in conjunction with the accompanying drawings. In the specification, in adding reference numerals to components throughout the drawings, it is to be noted that like reference numerals designate like components even though components are shown in different drawings. Further, in describing the present invention, a detailed description of related known functions or configurations will be omitted so as not to obscure the subject of the present invention.

Hereinafter, exemplary embodiments of the present invention will be described in detail with reference to the accompanying drawings.

For convenience of description, a multi-layer substrate of the present invention uses a substrate on which four insulating layers are stacked but is not limited thereto.

Further, it is to be noted that conductor layers other than conductor layers for a feeding part are omitted and thus, are not shown in the drawings of the present invention.

Figure 2:
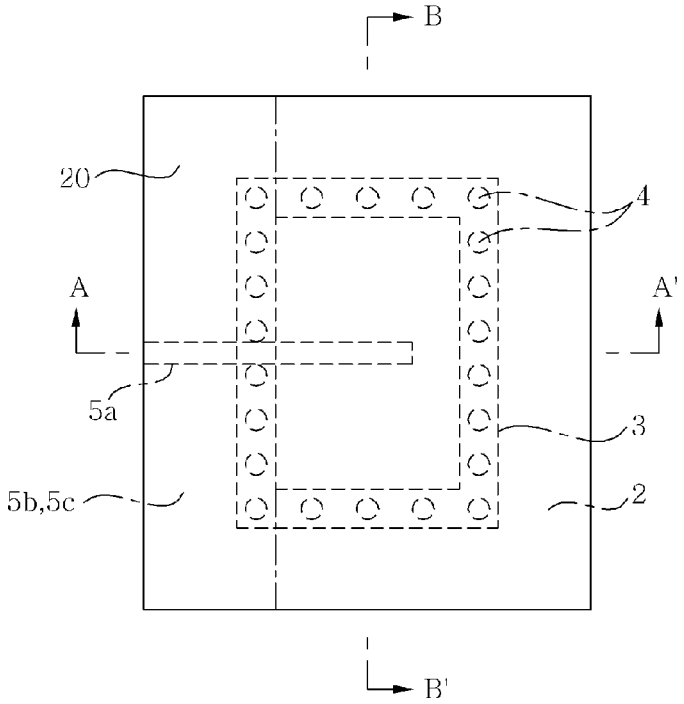
FIG. 2 is a plan view of a dielectric resonator antenna using the matching substrate of FIG. 1.
Figure 3:
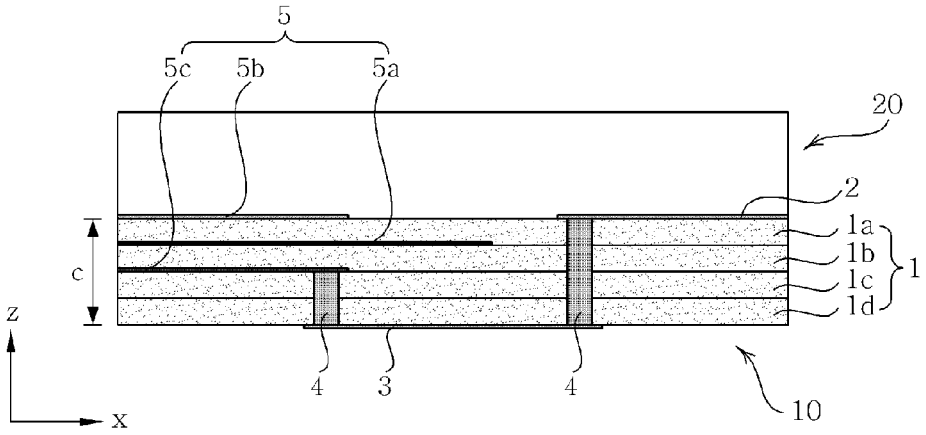
FIG. 3 is a cross-sectional view of the dielectric resonator antenna using the matching substrate of FIG. 1 taken along the line A-A' shown in FIG. 2.
Figure 4:
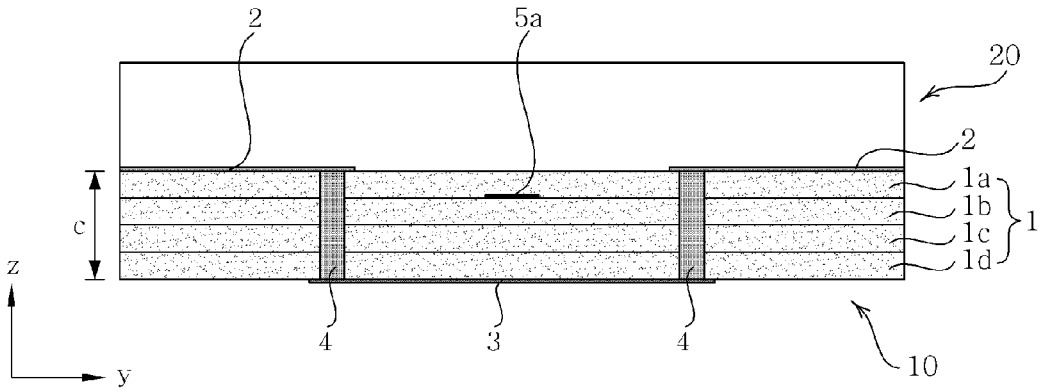
FIG. 4 is a cross-sectional view of the dielectric resonator antenna using the matching substrate of FIG. 1 taken along the line B-B' shown in FIG. 2.

FIG. 1 is a perspective view of a dielectric resonator antenna using a matching substrate according to a first embodiment of the present invention, FIG. 2 is a plan view of a dielectric resonator antenna using the matching substrate of FIG. 1, FIG. 3 is a cross-sectional view of the dielectric resonator antenna using the matching substrate of FIG. 1 taken along the line A-A' shown in FIG. 2, and FIG. 4 is a cross-sectional view of the dielectric resonator antenna using the matching substrate of FIG. 1 taken along the line B-B' shown in FIG. 2.

Referring to FIGS. 1 to 4, the dielectric resonator antenna using the matching substrate according to the first embodiment of the present invention is configured to include a dielectric resonator body part 10 that is embedded in the multi-layer substrate 1 and has the opening part on the upper portion thereof and a matching substrate 20 that is stacked on the opening part and stacked with at least one insulating layer.

For convenience of description of the present invention, only one matching substrate 20 is shown and described but two or more matching substrates may be stacked. In this case, it is preferable that the dielectric constant of the stacked matching substrate is stacked to be gradually reduced.

In addition, it is preferable that the dielectric constant $\in_2$ of the matching substrate 20 is smaller than the dielectric constant $\in_1$ of the multi-layer substrate 1 and larger than the dielectric constant $\in_0$ of air.

The dielectric resonator body part 10 includes the multi-layer substrate 1, a first conductor plate 2 that has an opening part on the upper portion of the top insulating layer 1*a* of the multi-layer substrate 1, a second conductor plate 3 that is disposed on the lower portion of the bottom insulating layer 1*d* of the multi-layer substrate 1, a plurality of first metal via holes 4 that penetrate through between the top insulating layer 1*a* and the bottom insulating layer 1*d*, and a feeding part 5 including a feeding line 5*a* and at least one of the ground plates 5*b* and 5*c*.

The multi-layer substrate 1 is formed by alternately stacking the plurality of insulating layers 1*a* to 1*d* and the plurality of conductor layers (for example, 2, 3, 5*a*, and 5*c*), thereby making it possible to build the dielectric resonator in the multi-layer substrate 1.

In the existing dielectric resonator body part, the interface surface operates like a magnetic wall by using the difference in the dielectric constant between the dielectric antenna formed on a single substrate in a parallelepiped shape or a cylindrical shape, thereby forming a resonance mode of a specific frequency.

On the other hand, according to the present invention, when the dielectric resonator is embedded in the multi-layer substrate 1, the resonance mode is maintained by using the metal interface surface in a vertical direction of the multi-layer substrate 1, the metal interface surface formed by a conductor plate formed on the lower portion of the bottom insulating layer, and the magnetic wall of the opening part formed on the upper portion of the top insulating layer.

Ideally, the metal interface surface in a vertical direction of the substrate is required in the multi-layer structure; however, it is difficult to make a metal interface surface. Therefore, the plurality of metal via holes arranged at predetermined intervals can be used instead of the metal interface surface.

Therefore, in order to build the dielectric resonator in the multi-layer substrate 1, the first conductor plate 2 having the opening part is formed on the upper portion of the top insulating layer 1*a*.

A second conductor plate 3 disposed at a position corresponding to the opening part is formed on the lower portion of the bottom insulating layer 1*d* from the first conductor plate 2, wherein the insulating layer is stacked with at least two layers.

Further, the plurality of first metal via holes 4 that electrically connects each layer between the top insulating layer 1*a* and the bottom insulating layer 1*d* and vertically penetrates through the multi-layer substrate 1 to form the metal interface surface in a vertical direction by covering the periphery of the opening part of the first conductor plate 2 at a predetermined interval are formed.

As a result, the dielectric resonator has only one surface (for example, a surface on which the opening part of the first conductor plate 2 is formed) opened, which is embedded in the multi-layer substrate 1 in a cavity form when the metal interface surface is formed by the first conductor plate 2, the second conductor plate 3, and the plurality of first metal via holes 4.

The feeding part 5 is formed at one side of the dielectric resonator in order to feed power to the dielectric resonator embedded in the multi-layer substrate 1 in the cavity form.

The feeding part 5 is implemented to feed power by using a transmission line (hereinafter, referred to a feeding line) as such as a strip line, a micro strip line, and a coplanar waveguide (CPW) line that can be easily formed on the multi-layer substrate 1.

The feeding part 5 is configured to include one feeding line 5*a* and at least one of the ground plates 5*b* and 5*c*.

The feeding part 5 of the dielectric resonator body part 10 shown in FIGS. 1 to 4 is formed to have a strip line structure.

More specifically, the feeding part 5 in the strip line structure is configured to include the feeding line 5*a*, the first ground plate 5*b*, and the second ground plate 5*c*.

The feeding line 5*a* is formed in a conductor plate in a line extending so as to be inserted into the dielectric resonator from one side of the dielectric resonator while being in parallel with the opening part of the dielectric resonator body part 10.

The first ground plate 5*b* is positioned to correspond to the feeding line 5*a* and is formed on the upper portion of the insulating layer 1*a* up from the feeding line 5*a*, wherein the insulating layer 1*a* is stacked with at least one layer.

The second ground plate 5*c* is positioned to correspond to the feeding line 5*a* and is formed on the lower portion of the insulating layer 1*b* down from the feeding line 5*a*, wherein the insulating layer 1*b* is stacked with at least one layer.

The above-mentioned first and second ground plates 5*b* and 5*c* should be formed at a position corresponding to the feeding line 5*a* but the size and form thereof are not limited.

The first ground plate 5*b* may be integrally formed with the first conductor plate 2.

As described above, the dielectric resonator body part 10 embedded in the multi-layer substrate 1 is supplied with a high frequency signal through the feeding line 5*a* of the feeding part 5 and serves as the antenna radiator that radiates the high frequency signal resonated at the specific frequency through the opening part according to the form and size of the dielectric resonator.

The matching substrate 20 is stacked on the opening part of the resonator body part 10 as described above.

The matching substrate 20 removes the reflected wave generated at the interface surface between the dielectric resonator body part 10 embedded in the high-K ($\in_1$) multi-layer substrate 1 and the low-K ($\in_0$) air, thereby making it possible to improve the bandwidth.

In general, the reflected wave is generated due to a mismatch between the system impedance $Z_1$ of the dielectric resonator body part 10 and the radiation resistance $Z_{in}$ of the opening part.

Therefore, the matching substrate 20 is stacked on the opening part of the dielectric resonator body part 10 to perform a similar function to a 90° transformer, such that impedance matching between the dielectric resonator body part 10 and air can be achieved.

Figure 5:
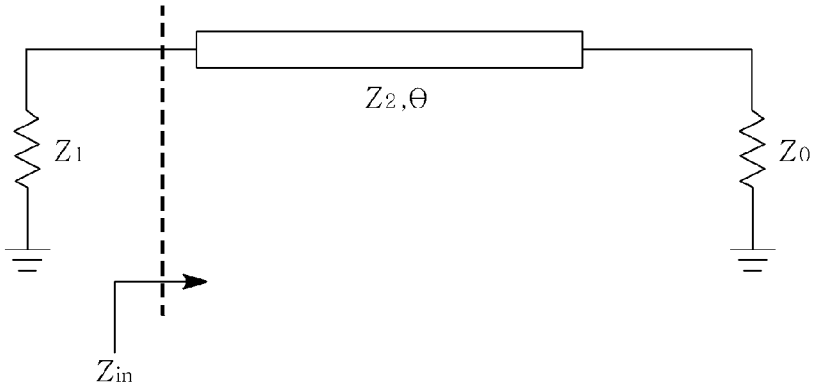
FIG. 5 is an equivalent circuit diagram of a transmission line for analyzing the function of the matching substrate according to the present invention.

FIG. 5 is an equivalent circuit diagram of a transmission line for analyzing a role of the matching substrate according to the present invention.

Referring to FIG. 5, if the system impedance of the dielectric resonator body part 10 is $Z_1$, the equivalent impedance of air is $Z_0$, the impedance of the matching substrate 20 positioned at the interface surface between the dielectric resonator body part 10 and the air is $Z_2$, the input impedance $Z_{in}$ viewed from the dielectric resonator body part 10 side is represented by the following Equation 1.

$$Zin = Z_2 \times \frac{Z_0 + jZ_2\tan\theta}{Z_2 + jZ_0\tan\theta} \quad (1)$$

In order to reduce the mismatch between the system impedance $Z_1$ of the dielectric resonator body part 10 and the equivalent impedance $Z_0$ of air, a quarter-wave matching theory is used.

It is assumed that the quarter-wave matching uses a 90° line. In this case, if it is substituted into Equation (1), it is transformed into the following Equation (2).

$$Zin = \frac{Z_2^2}{Z_0} \quad (2)$$

The mismatch between the system impedance $Z_1$ of the dielectric resonator body part 10 and the equivalent impedance $Z_0$ of air can be reduced by inserting the matching substrate 20 so that the input impedance $Z_{in}$ viewed from the dielectric resonator body part 10 side is the same as the system impedance $Z_1$ of the dielectric resonator body part 10, as represented by the following Equation (3).

$$Z_{in}=Z_1 \quad (3)$$

Therefore, the system impedance $Z_2$ value of the matching substrate 20 can be obtained by substituting Equation (3) into Equation (2).

$$Z_2=\sqrt{Z_0Z_1} \quad (4)$$

Meanwhile, when the system impedance Z is represented by dielectric constant $\in$ and permeability $\mu$, it can be generally represented as follows.

$$Z = \sqrt{\frac{\mu}{\epsilon}} \quad (5)$$

Using Equations (4) and (5), the dielectric constant $\in_2$ of the matching substrate 20 may be represented as follows.

$$\in_2=\sqrt{\in_0\times\in_1} \quad (6)$$

Where $\in_1$ is a dielectric constant of the multi-layer substrate 1 of the dielectric resonator body part 10 and $\in_0$ is the dielectric constant of air.

Figure 6:
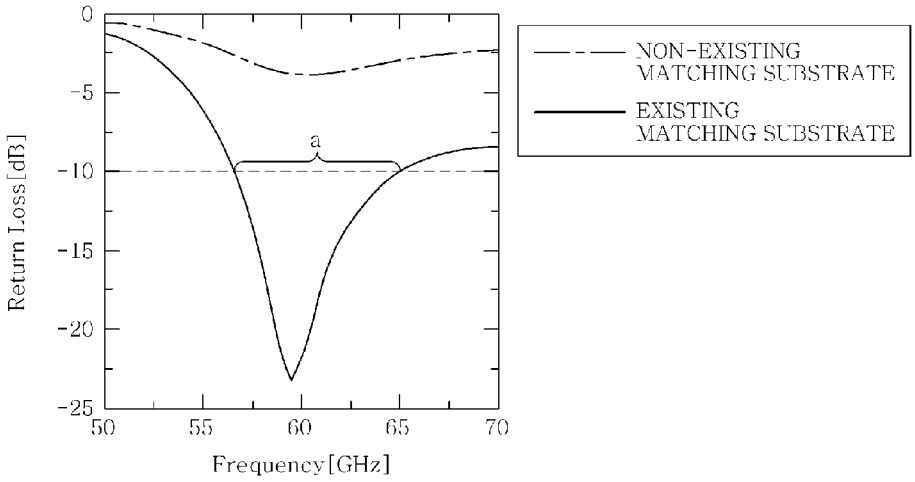
FIG. 6 is a simulation graph showing the change in antenna characteristics according to whether there is a matching substrate in an exemplary embodiment of the present invention.
Figure 7:
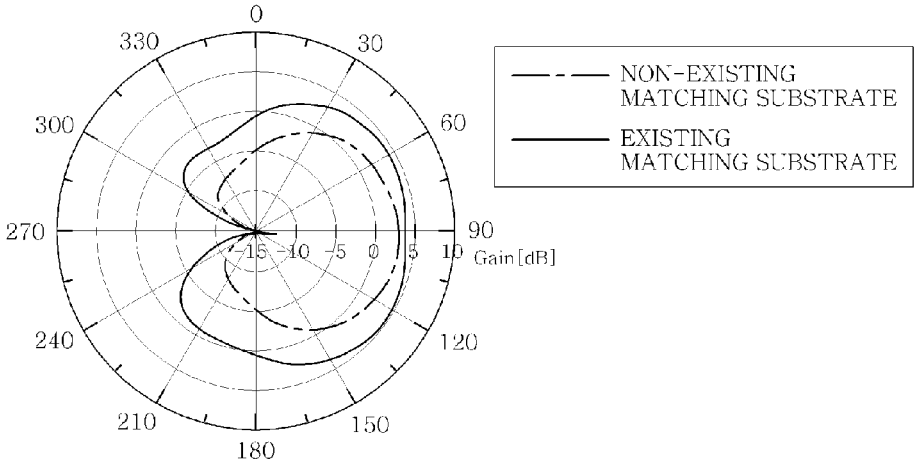
FIG. 7 is a diagram showing an E-plane radiation pattern at −10 dB matching frequency according to whether there is the matching substrate in an exemplary embodiment of the present invention.

FIG. 6 is a simulation graph showing the change in antenna characteristics in accordance to whether there is a matching substrate in an exemplary embodiment of the present invention, and FIG. 7 is a diagram showing an E-plane radiation pattern at −10 dB matching frequency in accordance to whether there is the matching substrate in an exemplary embodiment of the present invention.

Referring to FIG. 6, when there is no matching substrates 20, it cannot operate as an antenna having a predetermined bandwidth but when there is the matching substrates 20, antenna characteristics operating at a bandwidth of about 60 GHz or so (a band) based on a −10 dB matching frequency point are shown.

Further, referring to FIG. 7, upon comparing a gain value [dB] at 90° in accordance to whether there is the matching substrate 20, it can be noted that the gain value is about 2.84 dB when there is no matching substrate 20 and the gain value is about 3.84 dB when there is the matching substrate 20.

As shown in FIGS. 6 and 7, it can be appreciated that the matching substrate 20 is stacked on the opening part of the dielectric resonator body part 10 to improve the bandwidth without adjusting the size of the dielectric resonator body part 10.

Meanwhile, in order to obtain the maximum bandwidth, the dielectric constant and thickness of the matching substrate 20 should be increased, which leads to the loss of radiation energy and a change in radiation pattern. A method capable of preventing the loss of the radiation energy and the change in radiation pattern will now be described below.

Figure 8:
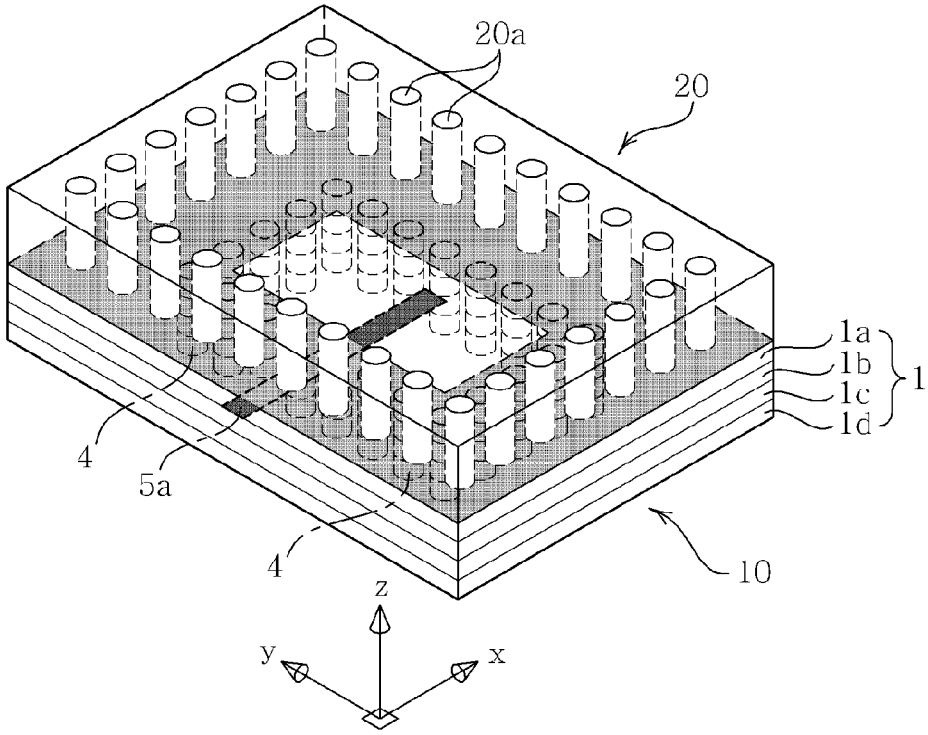
FIG. 8 is a perspective view of a dielectric resonator antenna using a matching substrate according to a second embodiment of the present invention.
Figure 9:
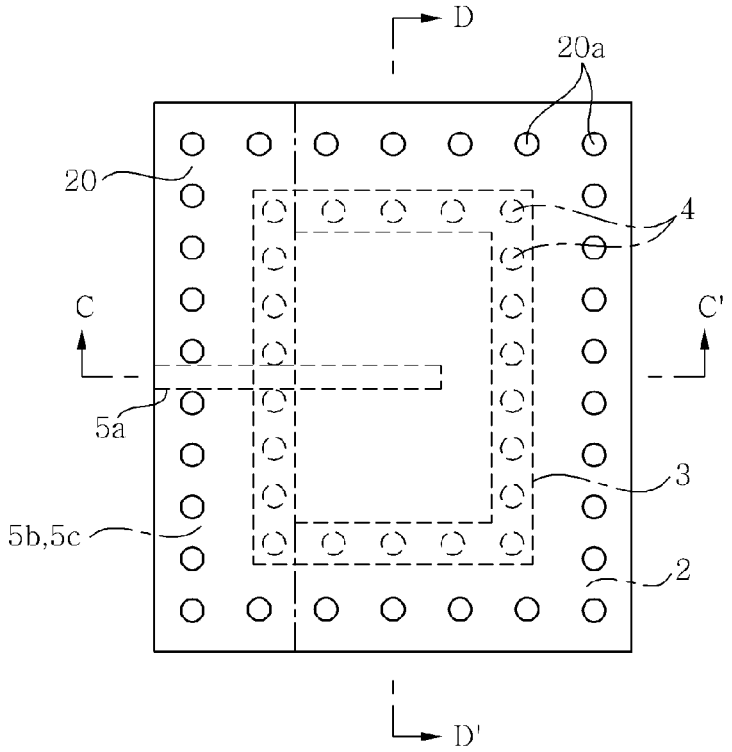
FIG. 9 is a plan view of a dielectric resonator antenna using the matching substrate of FIG. 8.
Figure 10:
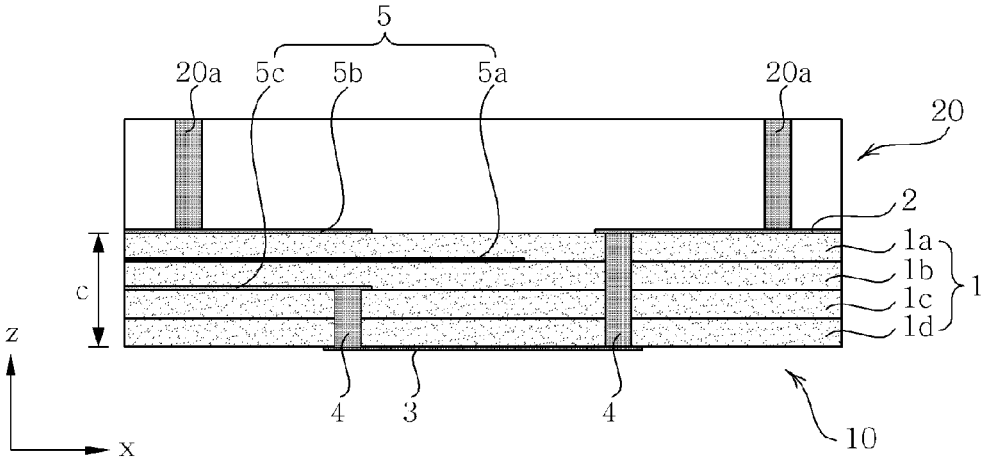
FIG. 10 is a cross-sectional view of the dielectric resonator antenna using the matching substrate of FIG. 8 taken along the line C-C' shown in FIG. 9.
Figure 11:
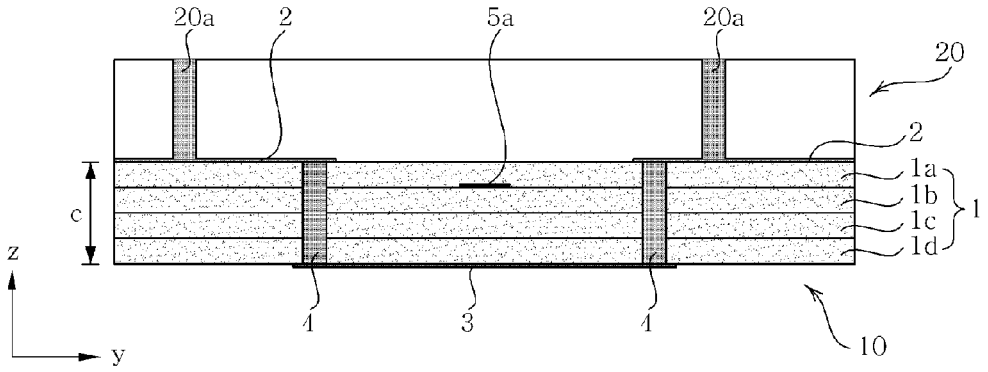
FIG. 11 is a cross-sectional view of the dielectric resonator antenna using the matching substrate of FIG. 8 taken along the line D-D' shown in FIG. 9.

FIG. 8 is a perspective view of a dielectric resonator antenna using a matching substrate according to a second embodiment of the present invention, FIG. 9 is a plan view of a dielectric resonator antenna using the matching substrate of FIG. 8, FIG. 10 is a cross-sectional view of the dielectric resonator antenna using the matching substrate of FIG. 8 taken along the line C-C' shown in FIG. 9, and FIG. 11 is a cross-sectional view of the dielectric resonator antenna using the matching substrate of FIG. 8 taken along the line D-D' shown in FIG. 9.

Referring to FIGS. 8 to 11, the dielectric resonator antenna using the matching substrate according to the second embodiment of the present invention is configured to include the dielectric resonator body part 10 that is embedded in the multi-layer substrate 1 and the matching substrate 20 that is stacked on the upper portion of the dielectric resonator body part 10.

The dielectric resonator body part 10 is the same as that of the first embodiment of the present invention and therefore, the detailed description thereof will not be repeated.

The matching substrate 20 used in the dielectric resonator antenna according to the second embodiment of the present invention is formed with a plurality of via holes 20*a* that form a vertical metal interface surface by covering the periphery of the opening part of the dielectric resonator body part 10.

The matching substrate 20 is formed with the plurality of via holes 20*a* to improve the loss of energy (energy loss generated by radiating energy radiated from the opening part of the dielectric resonator body part 10 to the side of the matching substrate 20) when the dielectric constant and thickness of the matching substrate 20 is increased and the change in radiation pattern, etc., due to the substrate mode.

Figure 12:
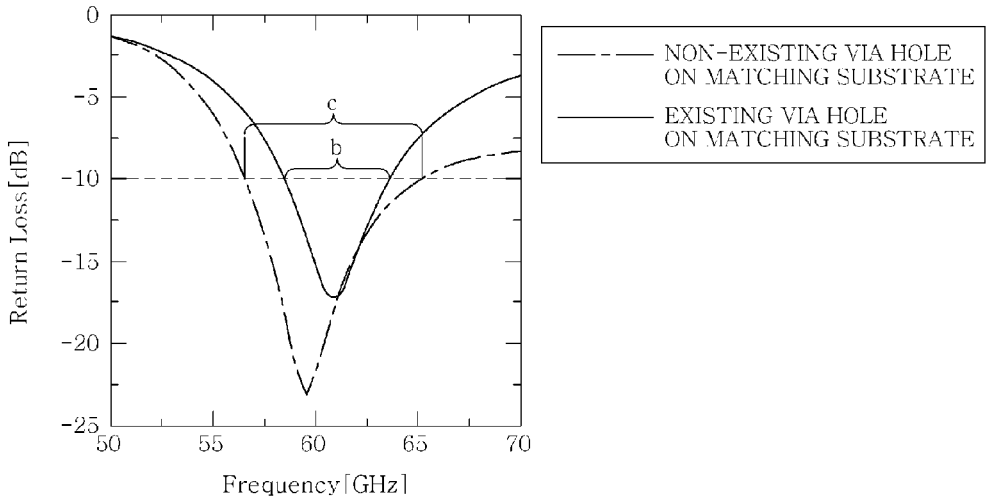
FIG. 12 is a simulation graph showing the change in antenna characteristics according to whether there are via holes formed on the matching substrate in an exemplary embodiment of the present invention.
Figure 13:
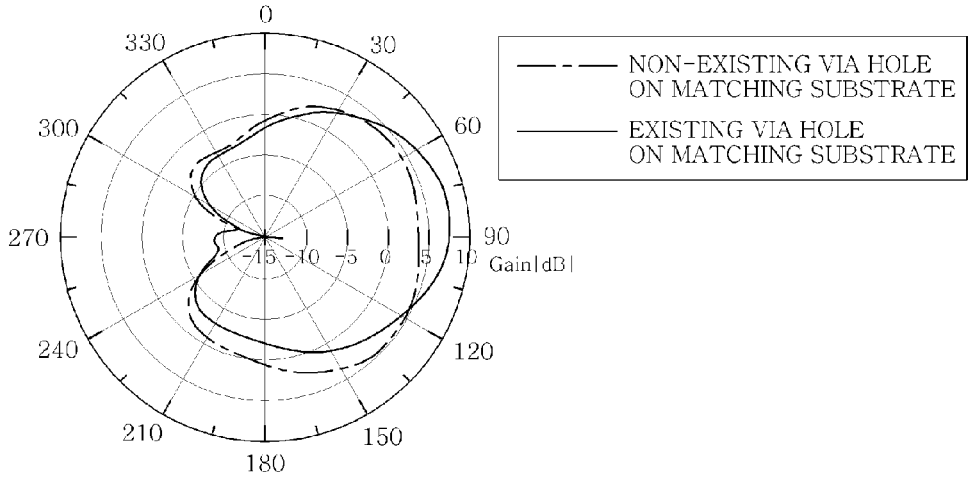
FIG. 13 is a diagram showing an E-plane radiation pattern at a −10 dB matching frequency according to whether there are via holes on the matching substrate in an exemplary embodiment of the present invention.

FIG. 12 is a simulation graph showing the change in antenna characteristics according to whether there are the plurality of via holes formed on the matching substrate in an exemplary embodiment of the present invention, and FIG. 13 is a diagram showing an E-plane radiation pattern at −10 dB matching frequency in accordance to whether there are a plurality of via holes on the matching substrate in an exemplary embodiment of the present invention.

Referring to FIG. 12, it can be appreciated that the bandwidth is slightly reduced based on the −10 dB matching frequency point when the matching substrate 20 is formed with the via holes 20*a* (b band), as compared with when there is no via holes 20*a* (c band).

However, upon comparing the gain value [dB] at 90° with reference to the radiation pattern shown in FIG. 13, it can be appreciated that when there are no plurality of via holes 20*a* on the matching substrate 20, the gain value [dB] is only about 3.84 dB, while when there are the via holes 20*a* on the matching substrate 20, the gain value [dB] is largely increased to about 7.44 dB.

The plurality of via holes 20*a* can be replaced with the metal via holes as well as the air via holes.

Figure 14:
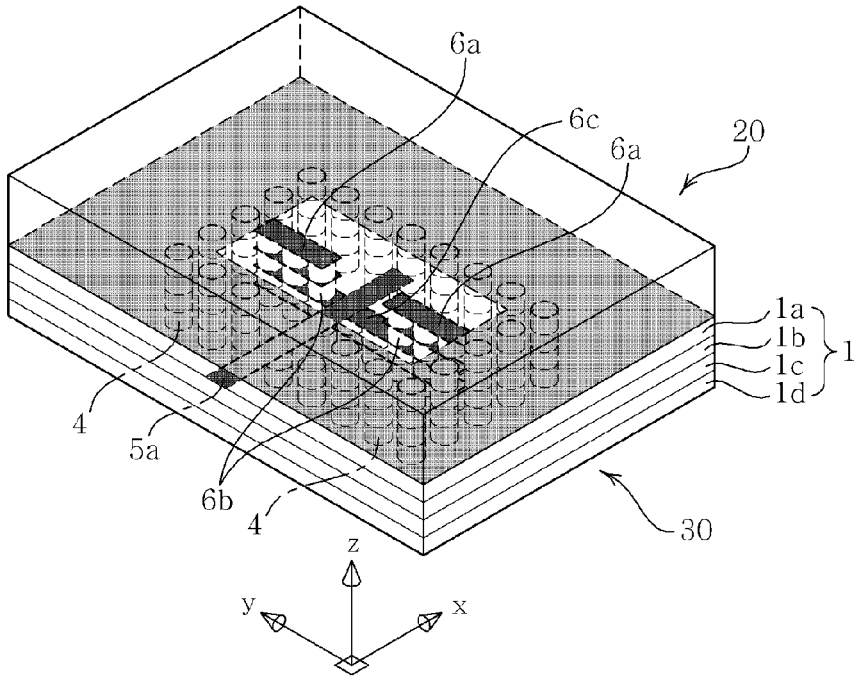
FIG. 14 is a perspective view of a dielectric resonator antenna using a matching substrate according to a third embodiment of the present invention.
Figure 15:
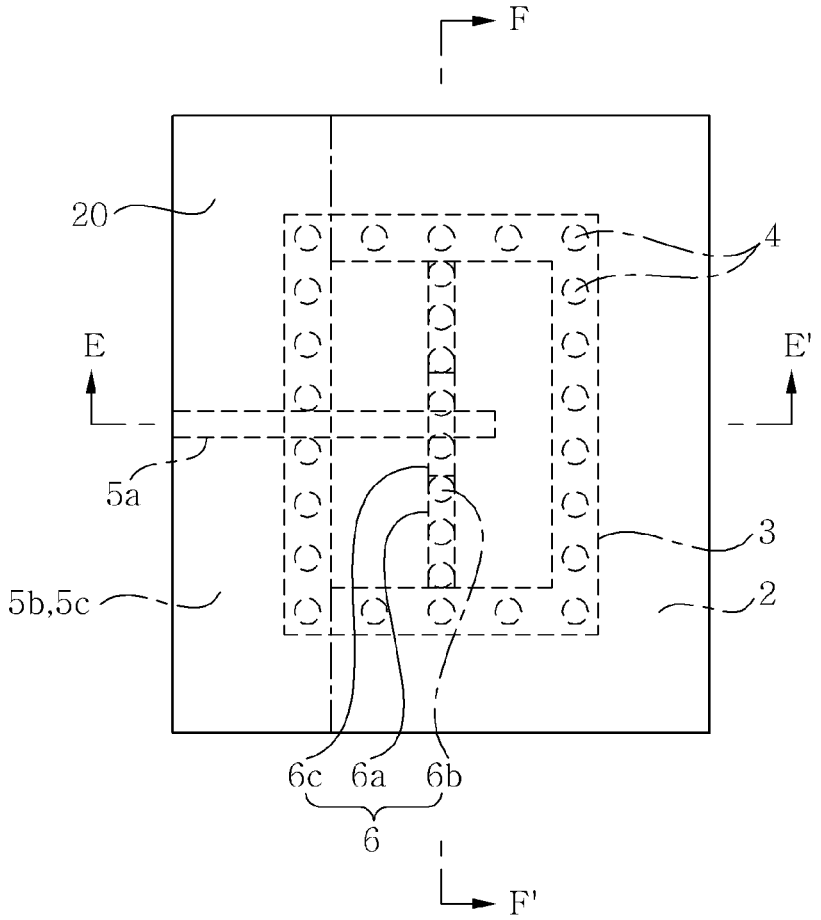
FIG. 15 is a plan view of a dielectric resonator antenna using the matching substrate of FIG. 14.
Figure 16:
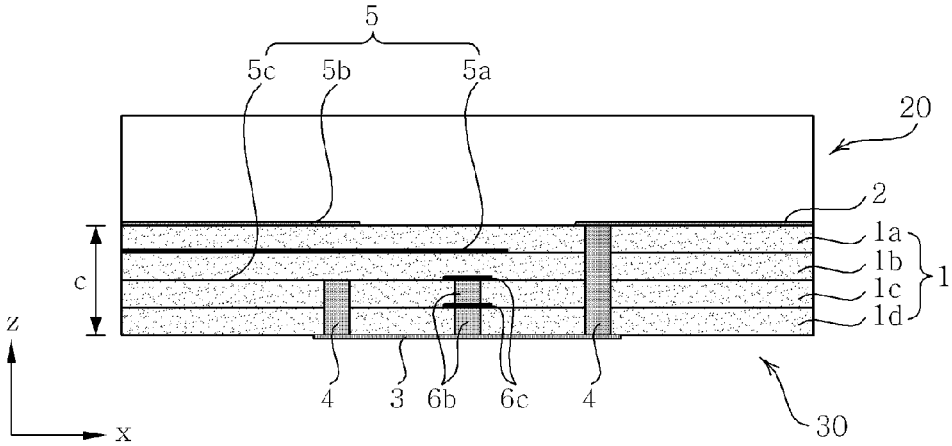
FIG. 16 is a cross-sectional view of the dielectric resonator antenna using the matching substrate of FIG. 14 taken along the line E-E' shown in FIG. 15.
Figure 17:
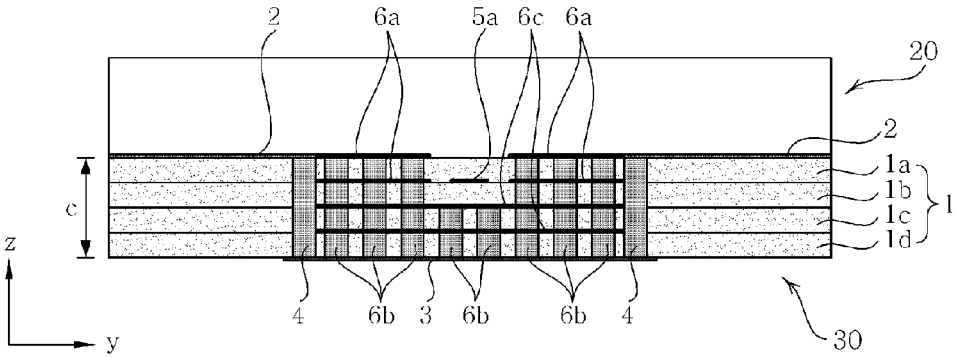
FIG. 17 is a cross-sectional view of the dielectric resonator antenna using the matching substrate of FIG. 14 taken along the line F-F' shown in FIG. 15.

FIG. 14 is a perspective view of a dielectric resonator antenna using a matching substrate according to a third embodiment of the present invention, FIG. 15 is a plan view of a dielectric resonator antenna using the matching substrate of FIG. 14, FIG. 16 is a cross-sectional view of the dielectric resonator antenna using the matching substrate of FIG. 14 taken along the line E-E' shown in FIG. 15, and FIG. 17 is a cross-sectional view of the dielectric resonator antenna using the matching substrate of FIG. 14 taken along the line F-F' shown in FIG. 15.

Referring to FIGS. 14 to 17, the dielectric resonator antenna using the matching substrate according to the third embodiment of the present invention is configured to include the dielectric resonator body part 30 that is embedded in the multi-layer substrate 1 and the matching substrate 20 that is stacked on the upper portion of the dielectric resonator body part 30.

The dielectric resonator body part 30 is configured to include the multi-layer substrate 1, the first conductor plate 2 having the opening part on the upper end of the top insulating layer 1*a* of the multi-layer substrate 1, the second conductor plate 3 disposed on the lower portion of the bottom insulating layer 1*d* of the multi-layer substrate 1, a plurality of first metal via holes 4 that penetrate between the top insulating layer 1*a* and the bottom insulating layer 1*d*, the feeding part 5 that is configured to include the feeding line 5*a* and at least one of the ground plates 5*b* and 5*c*, and a conductor pattern part 6 that is inserted into the dielectric resonator antenna.

The dielectric resonator body part 30 has the same structure as the dielectric resonator body part 10 used in the first and second embodiments, except for the conductor pattern part 6, and therefore, the detailed description of the same components will be omitted.

The conductor pattern part 6 is inserted into the dielectric resonator antenna in order to make the radiation characteristics of the antenna good by removing an additional mode $TM_{111}$ when the dielectric resonator body part 30 is operating in a double mode (for examples, a basic mode $TE_{101}$ and an additional mode $TM_{111}$).

When the conductor pattern part 6 is inserted into the dielectric resonator, it can effectively remove the additional mode $TM_{111}$ by removing the tangential field of the E-field formed in the dielectric resonator and keeping the normal field thereof at the time of the double resonance $TE_{101}$+ $TM_{111}$.

Since the conductor pattern part 6 has a strong field (E-field) at the center of the dielectric resonator when the dielectric resonator antenna is operating in the double resonance, it is most preferable that the conductor pattern part 6 is positioned at the center (a/2) of the length (a) in an X-direction that is parallel with the feeding line 5*a*.

Specifically, referring to FIGS. 16 and 17, the conductor pattern part 6 is formed on the lower portion of the insulating layer below the feeding line 5*a* to form the metal interface surface in a vertical direction intersecting with the feeding line 5*a* in the dielectric resonator, wherein the insulating layer is stacked with at least one layer.

The conductor pattern part 6 is formed in the dielectric resonator to include the plurality of second metal via holes 6*b* that vertically penetrate through the multi-layer substrate 1 and at least one third conductor plates 6*a* and 6*c* that are formed to be coupled with the plurality of second metal via holes 6*a* between the insulating layers 1*a* to 1*d* through which the plurality of second metal via holes 6*b* penetrate.

The conductor pattern part 6 may form the metal interface surface in a vertical direction intersecting with the feeding line 5*a* in the dielectric resonator in a conductor pattern that has a net shape as shown in FIG. 17 by the plurality of second metal via holes 6*b* and at least one third conductor plates 6*a* and 6*c*.

Referring to FIG. 17, the plurality of second metal via holes 6*b* should be formed on the lower portion of the insulating layer below the feeding line 5*a* based on the feeding line 5*a*, wherein the insulating layer is stacked with at least one layer.

Further, the plurality of second metal via holes 6*b* may be formed on all the insulating layers at the left and right sides based on the feeding line 5*a*.

However, the plurality of second metal via holes 6*b* should not be formed on all the insulating layers just above the feeding line 5*a* from the feeding line 5*a* to the opening part.

FIG. 17 shows that the conductor pattern part 6 is, but not limited thereto, a general horseshoe shape, but it may be formed in various shapes including a quadrangular shape.

The matching substrate 20 used in the dielectric resonator antenna using the matching substrate according to the third embodiment of the present invention is the same as the matching substrate 20 used in the dielectric resonator antenna using the matching substrate according to the first embodiment of the present invention and therefore, the detailed description thereof will be omitted.

Finally, FIGS. 18 to 21 show a fourth embodiment where the plurality of via holes 20*a* identical with those used in the dielectric resonator antenna using the matching substrate according to the second embodiment of the present invention are formed in the matching substrate 20 used in the dielectric resonator antenna using the matching substrate according to the third embodiment.

Figure 18:
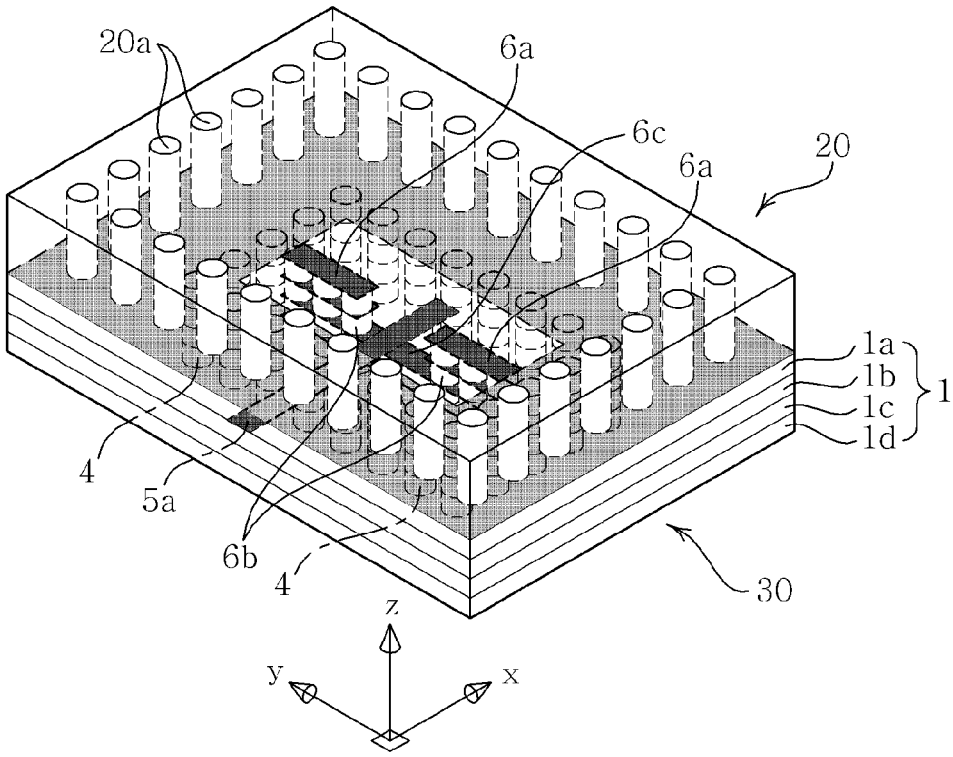
FIG. 18 is a perspective view of a dielectric resonator antenna using a matching substrate according to a fourth embodiment of the present invention.
Figure 19:
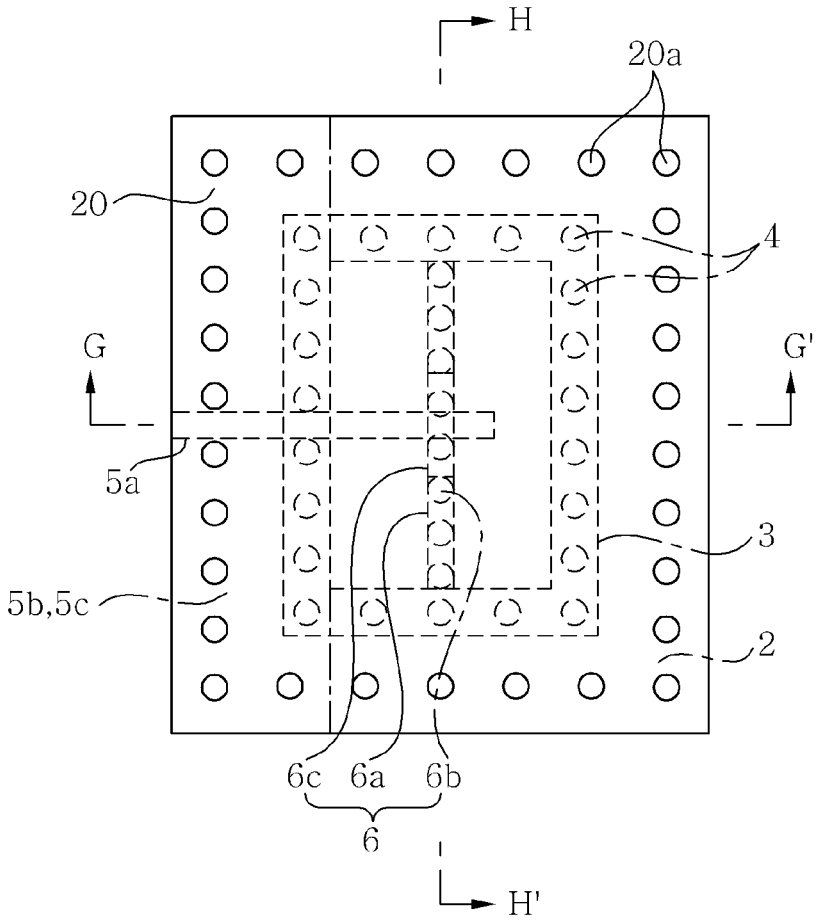
FIG. 19 is a plan view of a dielectric resonator antenna using the matching substrate of FIG. 18.
Figure 20:
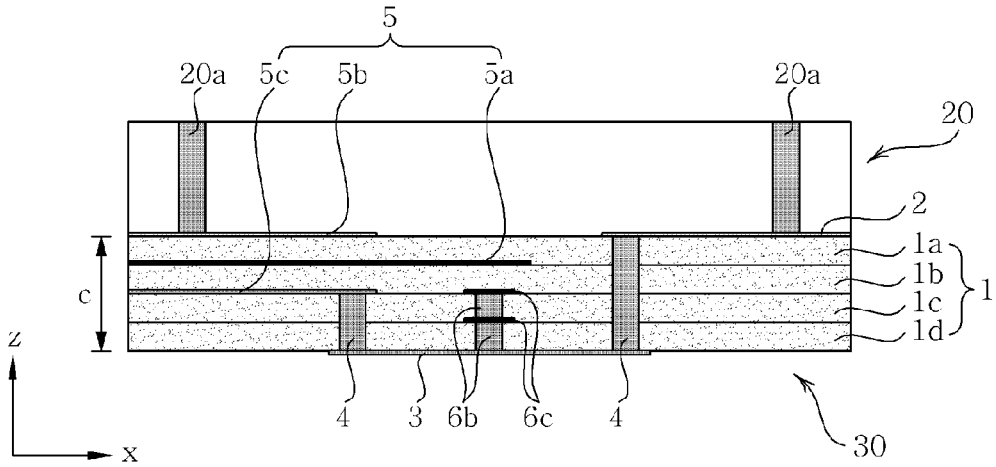
FIG. 20 is a cross-sectional view of the dielectric resonator antenna using the matching substrate of FIG. 18 taken along the line G-G' shown in FIG. 19.
Figure 21:
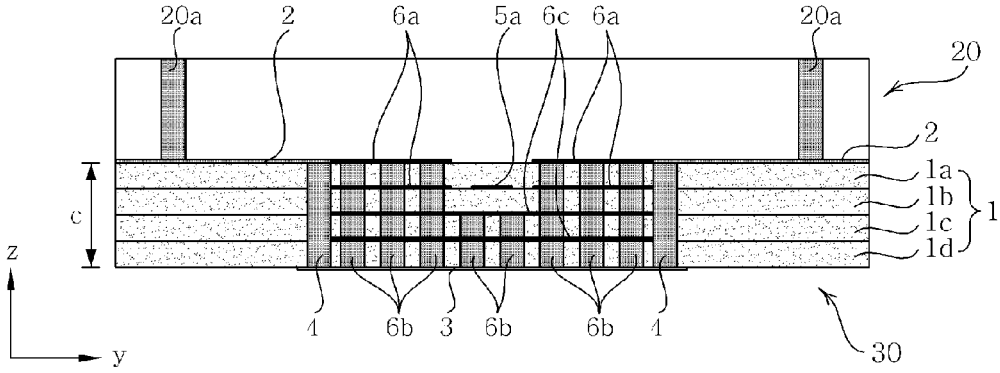
FIG. 21 is a cross-sectional view of the dielectric resonator antenna using the matching substrate of FIG. 18 taken along the line H-H' shown in FIG. 19.

FIG. 18 is a perspective view of a dielectric resonator antenna using a matching substrate according to a fourth embodiment of the present invention, FIG. 19 is a plan view of a dielectric resonator antenna using the matching substrate of FIG. 18, FIG. 20 is a cross-sectional view of the dielectric resonator antenna using the matching substrate of FIG. 18 taken along the line G-G' shown in FIG. 19, and FIG. 21 is a cross-sectional view of the dielectric resonator antenna using the matching substrate of FIG. 18 taken along the line H-H' shown in FIG. 19.

Referring to FIGS. 18 to 21, the dielectric resonator antenna using the matching substrate according to the fourth embodiment of the present invention is configured to include the dielectric resonator body part 30 that is embedded in the multi-layer substrate 1 and the matching substrate 20 that is stacked on the upper portion of the dielectric resonator body part 30.

The dielectric resonator body part 30 is the same as that used in the third embodiment of the present invention and the matching substrate 20 is the same as that used in the second embodiment of the present invention and the detailed description thereof will not be repeated.

As described above, the dielectric resonator antenna using the matching substrate according to the first to fourth embodiments of the present invention stacks the matching substrate 20 on the opening part of the dielectric resonator bodies 10 and 30 embedded in the multi-layer substrate 1, thereby making it possible to improve the bandwidth without adjusting the size of the dielectric resonator bodies 10 and 30 and simplify the process.

In addition, the matching substrate 20 stacked on the dielectric resonator bodies 10 and 30 serves to prevent the change in antenna characteristics due to the insertion of foreign materials in the dielectric resonator bodies 10 and 30 through the opening part or surface damage of the antenna.

In addition, the plurality of via holes 20*a* are formed on the matching substrate 20, thereby making it possible to prevent loss and change in the radiation pattern due to the substrate mode generated when the thickness of the matching substrate 20 is increased in order to obtain the maximum bandwidth.

With the present invention, the dielectric resonator antenna using the matching substrate can reduce process errors and the change in antenna characteristics due to an external environment, can improve the bandwidth without readjusting the size of the dielectric resonator antenna, and can be easily manufactured, as compared with the existing patch antenna or the stack-patch antenna.

Further, with the present invention, the dielectric resonator antenna using the matching substrate can prevent the change in antenna characteristics due to the insertion of foreign materials in the dielectric resonator antenna or the surface damage of the antenna by the matching substrate.

Further, with the present invention, the dielectric resonator antenna using the matching substrate forms the plurality of via holes on the matching substrate, thereby making it possible to prevent the loss and the change in radiation pattern due to the substrate mode.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Accordingly, such modifications, additions and substitutions should also be understood to fall within the scope of the present invention.

What is claimed is:

1. A dielectric resonator antenna, comprising:

a multi-layer substrate on which a plurality of insulating layers and conductor layers are alternately stacked;

a first conductor plate that has an opening part at the center of the upper portion of a top-most insulating layer of the multi-layer substrate;

a second conductor plate that is formed on the lower portion of a bottom-most insulating layer, the insulating layers being formed with at least two stacked layers and are disposed, at the center of a position corresponding to the opening part;

a first plurality of metal via holes that electrically connect each layer between the top insulating layer and the bottom insulating layer and vertically penetrate through the multi-layer substrate to form a metal interface surface in a vertical direction around the periphery of the opening part of the first conductor plate at a predetermined interval;

a feeding part including a feeding line to apply a high-frequency signal to the dielectric resonator embedded in the multi-layer substrate in a shape of a cavity by a metal interface surface formed with the first conductor plate, the second conductor plate, and the first plurality of metal via holes; and, a matching substrate that is stacked on the first conductor plate so as to cover the opening part and is stacked with at least one insulating layer;

wherein the matching substrate includes a third plurality of via holes that vertically penetrate through the matching substrate;

wherein the dielectric resonator does not have patch antennas;

wherein the first conductor plate and the second conductor plate are electrically connected to each other through the first plurality of the metal via holes;

wherein the second conductor plate are directly contacted with the first plurality of metal via holes;

wherein the dielectric resonator body part includes a conductor pattern part inserted in the dielectric resonator to form the metal interface surface in a vertical direction intersecting with the feeding line;

wherein the dielectric constant of the matching substrate is smaller than that of the multi-layer substrate and is larger than that of air;

wherein the matching substrate removes a reflected wave occurred on the interface surface between the dielectric resonator body part embedded in the multi layer substrate having the high dielectric constant and the air having the low dielectric constant so as to increase a bandwidth; and wherein the conductor pattern part removes a tangential field of an electric field formed on the dielectric resonator body part and keeps a normal field at the time of the double resonance.

2. The dielectric resonator antenna as set forth in claim 1, wherein the conductor pattern part is inserted in the dielectric resonator to include:

a second plurality of metal via holes that vertically penetrate through the multi-layer substrate; and at least a third conductor plate that is formed to be coupled with the second plurality of metal via holes between the insulating layers through which the second plurality of metal via holes penetrate.

3. The dielectric resonator antenna as set forth in claim 1, wherein the feeding part is any one of a strip line structure, a micro strip line structure, or a CPW line structure.

4. The dielectric resonator antenna as set forth in claim 1, wherein the third plurality of via holes further form the metal interface surface in a vertical direction around the periphery of the opening part.

5. The dielectric resonator antenna as set forth in claim 1, wherein the third plurality of via holes are metal via holes.

6. The dielectric resonator antenna as set forth in claim 1, wherein the third plurality of via holes are air via holes.

7. The dielectric resonator antenna as set forth in claim 1, wherein when at least two matching substrates are stacked, the matching substrates are stacked to gradually reduce the dielectric constant of the stacked matching substrate.

* * * * *